United States Patent [19]

Ayers

[11] 4,298,553

[45] Nov. 3, 1981

[54] METHOD OF PRODUCING LOW OXIDE METAL POWDERS

[75] Inventor: Maurice D. Ayers, Stamford, Conn.

[73] Assignee: Metal Innovations, Inc., Stamford, Conn.

[21] Appl. No.: 962,488

[22] Filed: Nov. 20, 1978

Related U.S. Application Data

[63] Continuation of Ser. No. 474,210, May 29, 1974, abandoned, Continuation-in-part of Ser. No. 229,307, Feb. 25, 1972, Pat. No. 3,814,558, Continuation-in-part of Ser. No. 855,096, Sep. 4, 1969, Pat. No. 3,646,176.

[51] Int. Cl.[3] ..... B01J 2/06

[52] U.S. Cl. ..... 264/11; 264/13; 264/14

[58] Field of Search ..... 264/11, 13, 14

[56] References Cited

U.S. PATENT DOCUMENTS 3,334,408 8/1967 Ayers ..... 264/11
3,551,532 12/1970 Laird ..... 264/11

OTHER PUBLICATIONS

Chemical Engineers Handbook, 4th ed., McGraw-Hill Book Co., New York, 1963, pp. 6-29 to 6-32.

*Primary Examiner*—Donald E. Czaja
*Assistant Examiner*—James R. Hall
*Attorney, Agent, or Firm*—Mandeville and Schweitzer

[57] ABSTRACT

A method is disclosed for producing high purity metal powders having an irregular and angular shape and a very low oxygen content (less than 0.25% oxygen in iron and steel powders). The invention utilizes a multiple stage high pressure liquid atomization procedure for converting the molten metal to angular particulate form, and provides for the very rapid subsequent cooling of the hot particle under conditions of high pressure sprays and violent turbulence of the powder particles in the liquid that minimize the formation of oxide impurities on the particles surface. High pressure atomization to produce angular and irregular particles tends to create an oxidizing environment because of the mixture of hot particles and liquid. By rapidly quenching the particles immediately after formation, in a quenching environment that creates a violently turbulent condition at the surface of the metal particles, the formation of vapor or steam films is minimized and more rapid heat transfer from the particles to the cooling medium is realized. Special procedures are followed to exlude air in the atomizing chamber prior to, during and after atomization of the molten metal. The disclosed method represents an extension and an improvement over the process of U.S. Pat. No. 3,646,176.

In the process of the invention, vacuum is created in the atomizing chamber, by the action of the high pressure sprays, and this has significant processing advantages. The tendency for this vacuum to draw water into the atomizing zone is effectively controlled by properly directing and confining the spray jets after issuance from the nozzles.

10 Claims, 4 Drawing Figures

METHOD OF PRODUCING LOW OXIDE METAL POWDERS

RELATED APPLICATIONS

This application a continuation of Application Ser. No. 474,210, filed on May 29, 1974, now abandoned which, in turn, is a continuation-in-part of my application Ser. No. 229,307, filed Feb. 25, 1972, which on June 4, 1974 matured into U.S. Pat. No. 3,814,558. The prior patent application, in turn, was a continuation-in-part of my application Ser. No. 855,096, filed Sept. 4, 1969, now U.S. Pat. No. 3,646,176, granted Feb. 29,1972. This application is also related to and represents an improvement over my earlier U.S. Pat. No. 3,334,408, granted Aug. 8, 1967.

BACKGROUND OF THE INVENTION

Metal powders have gained increasing popularity in recent years mainly because of new, practical and commercially feasible methods for producing them. Metal powders can be produced by a number of processes including atomization of the molten metal by liquids or gases under pressure. A particularly advantageous method for the liquid atomization of molten metals, particularly iron or steel, is disclosed in my U.S. Pat. No. 3,334,408. Briefly, the method disclosed in the foregoing patent involves the use of pairs of high velocity, thin, solid flat streams of cooling liquid that angularly impinge upon a stream of the molten metal to disperse it into fine, irregularly shaped powder particles. The powder particles thus formed are quenched and may be subsequently molded or compacted into coherent forms having many commercial applications.

I have found that the techniques adopted for the production of optimum powder shapes (i.e., irregular, angular) are inherently conducive to rapid surface oxide formation. Thus, iron powders produced by the liquid atomization of molten iron or steel generally have an oxygen content of more than about 0.7% after quenching and between about 0.8% and 1.0% after being dried. In order to use such iron powders for high quality products, (i.e., those requiring a low oxide impurity grade iron), the oxygen content of the powder should be reduced to less than about 0.25%. The removal of such oxide impurities from iron powders can be accomplished by annealing the powder in a reducing atmosphere in accordance with well known procedures. However, the annealing process can have adverse effects on the powder, as by undesirably increasing the grain size. It also has been found that the annealing of iron powder relieves energy and internal stresses in the particles which I have found to be advantageous for the subsequent processing of wrought products.

The oxidation of iron powder particles produced by liquid atomization of the molten metal is a function of many variables, including the particle size, time at elevated temperature, and environment. Iron powder will oxidize very rapidly at temperatures down to about 300° F. in an oxidizing environment. However, when cooled to below about 200° F., the oxidation rate is relatively slow. Oxide formation also, of course, can occur during the drying of liquid atomized powder, which tends to compound the problem of high oxide formation.

Heretofore, where low oxide powders have been required, it has been conventional to utilize gas atomizing techniques, rather than liquid atomization, to derive the metal powders. However, gas atomizing techniques have many significant disadvantages. For one thing, the production capacity of a gas atomizing system is very low, as there is a relatively low rate of heat transfer between the hot metal and the atomizing gas. Additionally, the cost of the atomizing gas, which must be inert, is a significant factor in the economics of the system. Moreover, since the metal is cooled down at a relatively slow rate by gas atomization procedures, the atomized metal forms into particles of spherical shape, and particles of spherical shape are disadvantageous, as compared to irregular, angular particles produced by liquid atomization, for many end uses. Thus gas atomization has not provided a satisfactory answer to the production of low oxide atomized powder.

SUMMARY OF THE INVENTION

The present invention is directed to a new process enabling low oxide atomized metal powders to be produced by liquid (typically water) atomizing procedures. This enables the high production capacities and favorable economics of the liquid atomizing techniques to be realized, and also accommodates the production of angularly shaped, irregular metal particles, which are advantageous for subsequent processing.

In accordance with the present invention, molten metal is subjected to liquid atomization in a procedure of two or more distinct but closely timed stages. In the first stage, a controlled stream of the molten metal is acted on by thin, flat, solid sheets of atomizing liquid, which are disposed to intersect in the form of a Vee and are ejected under high pressure. The interception of molten metal by the high pressure flat streams causes the molten metal stream to be shattered and dispersed into fine metal particles of the desired angular, irregular shape. Almost immediately thereafter, the atomized metal particles, still at high temperature, are struck by at least one and in some cases two or more additional sets of liquid jets, the function of which is to effect extremely rapid transfer of heat from the hot metal particles to the liquid by intimate contact between the water and the particles under conditions of substantial pressure velocity and agitation. The hot particles are maintained continuously in highly turbulent contact with cooling liquid, until the particles are reduced to a temperature of, say, 200° F., at which temperature the tendency to oxidize is significantly reduced. Typically, the process is carried out by directing the particles, immediately after being struck by the subsequent stages of liquid jets, into a highly turbulent water body which disperses the particles and continues the cooling to a desired final level of around 200° F. or below.

In the process of the invention, an inert or at least non-oxidizing environment is maintained at all stages in which the metal is being atomized and then quenched by jets of cooling liquid, in order to reduce to a minimum the exposure of the metal to oxidation during its critical, higher temperature stages, to reduce the possibility of explosion and, importantly, to control the vacuum produced in the water leg formed by the action of the atomizing and quenching jets. Obviously, this substantially precludes any entry of air into the atomizing zone. Nevertheless, some oxygen will be present for reaction with the high temperature metal particles, as from the water vapor which is necessarily present, and the rapid quenching of the atomized particles to a temperature below that at which oxidation reactions readily occur is a critical aspect of the process. In this respect, once the molten metal stream is disintegrated into fine metal particles, the surface area available for oxidation reactions is enormously increased, and the tendency to form some oxides is correspondingly increased.

In the process of the invention, the atomization-quenching sequence is required to be carried out in two or more distinct stages, in order to achieve the combined results of a small, angular, irregularly shaped particle and a sufficiently low overall oxygen content. Thus, as described in the beforementioned related patents, in order to achieve small, angular, irregular particles, as desired, it is necessary to intercept a descending metal stream, typically of $\frac{1}{4}$ to $\frac{1}{2}$ inch in diameter, with intersecting thin, flat, solid streams of liquid, typically water, at high pressure. These atomizing streams are sufficiently thin (i.e., using spray nozzle openings about 1/32 to 1/16 of an inch in thickness) to achieve the desired particle size and to establish a desired particle shape. However, one set of sprays lacks adequate liquid volume to achieve sufficient heat transfer from the particles in the region of water and hot metal contact to fully solidify the particles or to avoid substantial oxidation. In other words, I have found heretofore that the requirements of achieving a sufficiently high rate of heat transfer, on the one hand, and a desired particle shape and size, on the other, with a single set of liquid streams, are mutually inconsistent. Accordingly, as set forth in my related patents, the atomized metal, immediately following atomization, is again forcibly struck by at least one additional set of liquid streams. The additional set or sets of streams are of sufficient thickness and volume to effect a high rate of heat transfer from the high temperature powder particles, and to rapidly cool the small particles, fixing the desired irregular shape and rapidly quenching the particles. At the second stage of liquid jets, the metal already has been substantially atomized, so that the additional stages of jets are controlled for optimum heat transfer.

After the quenching stage (or stages) of jets, the particles are directed immediately into a turbulent body of cooling water which further cools the particles down to below 200° F. A condition of violent turbulence between the particles and quenching water must be maintained, until the particles are in a temperature below the boiling point of the water. This minimizes sustained contact of the metal surfaces with water vapor, which is a reactive, oxide-forming media.

Pursuant to the improved process, special procedures are followed to exclude ambient air from the interior of the atomizing zone from a time prior to the start of atomizing to a time subsequent to its completion. To this end, the lower or discharge end of the atomizing chamber is sealed by water while the upper or input end is sealed by a combination of means. Prior to commencement of atomizing the pour opening to the chamber is sealed by a membrane, which is destroyed when the pour of molten metal commences. During atomizing, the pour opening is sealed by the molten metal itself. And, at the end of the atomizing, a plug is inserted into the pour opening before the reservoir of molten metal has been fully exhausted.

According to another aspect of the invention, atomizing and cooling jets are operated in the atomizing chamber at such a velocity as will result in operating vacuums within the chamber of as much as twelve inches of mercury and rarely if ever less than about three to four inches of mercury. To prevent water from being drawn up into the atomizing zone in such circumstances requires, in accordance with the invention, a combination of controlled introduction of inert or non-oxidizing gas into the atomizing zone along with controlled direction and velocity of water outflow in the lower portion of the atomizer housing. By properly directing and controlling the atomizing jets and the outflowing water, the high pressure water jets may be utilized in part to force the outflowing water through a restricted discharge opening. This, in combination with the controlled introduction of gas, serves to reliably keep the atomizing areas from being flooded.

Iron powder or other metal powders, for example, can be produced in accordance with the invention to have an oxygen impurity content at the extraordinarily low level of significantly less than 0.25%, even after drying. In this connection, it will be understood that, under normal circumstances, iron or other metal powder may include as much as 0.05% (more or less) oxygen even before atomizing, and also that the atomized powder will be subject to some oxide formation (and therefore additional oxygen pick-up) during a drying step, because of the elevated temperature conditions necessarily involved in the economical drying of water atomized powders.

The techniques of the present invention are especially significant in the production of atomized powders from certain classes of metals and alloys, such as tool steel alloys, for example. Many alloyed materials contain oxygen-reactive components such as chromium, aluminum, titanium, manganese, silicon, etc. The oxides formed with many of these reactive materials are difficult, if not impossible, to reduce in subsequent operations. Therefore, the techniques of water atomizing these materials under circumstances which substantially minimize the formation of oxides in the first place are especially valuable.

For a more complete understanding of the invention, reference should be made to the following detailed description and to the accompanying drawings.

DESCRIPTION OF PREFERRED EMBODIMENT

Figure 1:
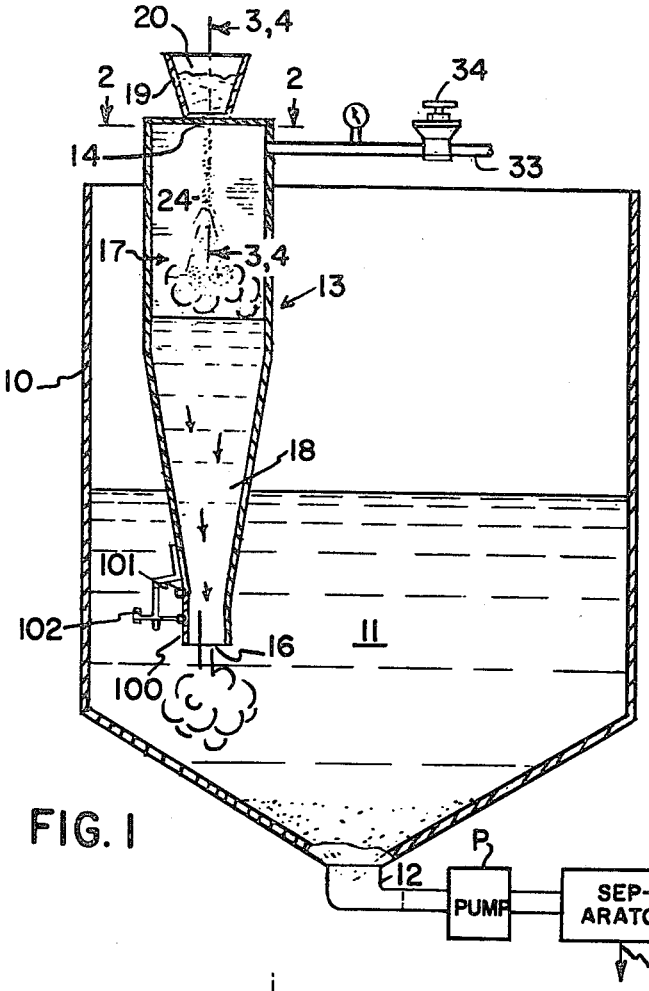
FIG. 1 is a simplified, schematic representation of a liquid atomization apparatus incorporating the principles of the invention.

Referring now to the drawings in which like reference characters refer to like parts throughout the several views thereof, the reference numeral 10 in FIG. 1 designates a large open top receiving tank. The receiving tank retains a body of cooling liquid, typically water, designated by the reference numeral 11. The tank is also provided with an outlet opening 12 for removal of water and particulate matter, as will be described.

Suitably mounted on the receiving tank 10 is an atomizer housing 13. In accordance with the invention, the housing 13 constitutes a sealed enclosure. It is provided, however, with an opening 14 at the top for the introduction of molten metal for atomization, with an opening 15 in an upper portion thereof for admitting inert or non-oxidizing gas, and with a discharge opening 16 in its lower extremity, below the water level in the retaining tank 10. As indicated in FIG. 1, the discharge end 16 of the atomizer housing is of smaller dimensions than the upper portions thereof constituting the atomizing chamber 17. By way of example only, in an apparatus of typical proportions for pilot-scale operations, the atomizing chamber portion of the housing may be of generally rectangular cross section, having internal cross sectional dimensions on the order of 10 by 15 inches and a thickness dimension on the order of 10 inches. The discharge opening 16, on the other hand, may have a thickness dimension (vertical in FIG. 1) on the order of about 1½ inches, with a width dimension on the order of 6 inches. Between the atomizing chamber 17 and the discharge opening 16 the atomizer housing advantageously tapers gradually and symmetrically in its thickness and width dimensions. The overall height may be on the order of about 40 inches.

In accordance with the invention, the size of the discharge opening 16 should be properly correlated with the volume and velocity of water outflow and the level of vacuum within the atomizing chamber (taking into account the pressure-controlling introductions of non-oxidizing or inert gas in the upper portion of the chamber). In this respect, I have found that the outflow of water from the discharge opening 16 should be at least about five gallons per minute per square inch of outlet area, over substantially the entire area, in order to reliably avoid occasional back rush of water up into the atomizing chamber during atomization. This provides for an average velocity of outflow on the order of 100 feet per minute or more. As will be appreciated, the atomization of different metals having different melting temperatures, different specific heat values and/or different gas contents may dictate variations in the velocity and volume of water inflow at the atomizing nozzles for optimum results in the atomizing zone. Accordingly, to provide an appropriately restricted discharge nozzle area for the outlet 16 for all conditions, provision is made for adjustably restricting said opening from a predetermined maximum size to an appropriate smaller size. In the illustrated apparatus, the outlet nozzle area of the atomizing system includes a flap 100, which is pivoted at 101 to the lower end of the water leg section 18 and forms one wall of the discharge nozzle. Suitable means, such as an adjusting screw 102, may be provided for retaining the flap in a pre-adjusted position to define an adjustable outlet opening. Thus, if reduced volume of atomizing water is indicated by process requirements, it may be necessary or desirable to correspondingly restrict the outlet opening 16, by adjustment of the flap 100, to maintain water outflow velocity at or above the desired minimum level.

At the top of the atomizer housing 13 there is a receiving crucible 19 adapted, when the system is in operation, to receive a body of molten metal 20. The crucible 19 has an opening 21 in its bottom wall, which communicates with the interior of the atomizer housing 13 through a like opening 121 and provides for the gravity discharge of molten metal in a solid stream. The diameter of the opening 121 is such that the descending stream of molten metal desirably is on the order of ⅜ of an inch in diameter, although larger sizes (e.g., 7/16 inch) may be utilized, as will be discussed below, in some instances.

Figure 3:
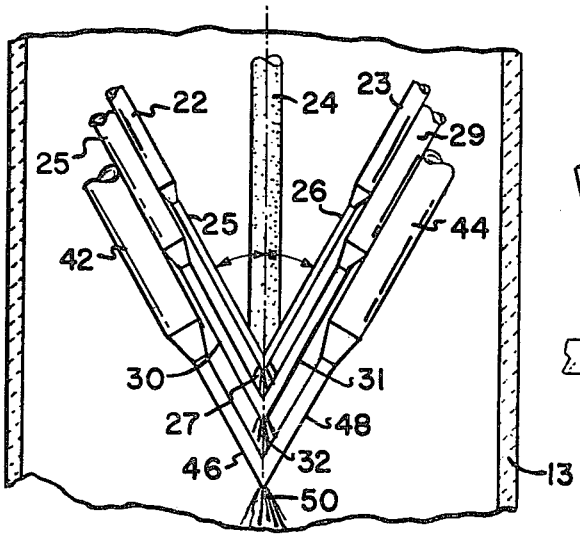
FIG. 3 is an enlarged cross section taken generally on line 3—3 of FIG. 2.
Figure 4:
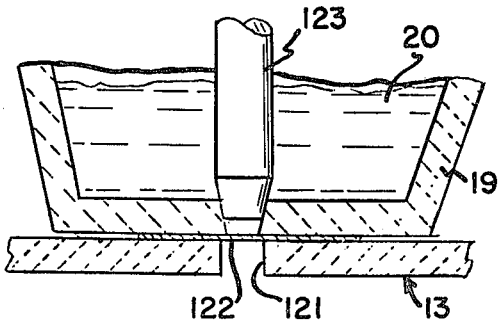
FIG. 4 is an enlarged cross section taken generally on line 4—4 of FIG. 1.

In accordance with one embodiment of the invention, two or more sets of liquid spray jets are provided in the atomizing chamber 17, disposed to act in rapid sequence upon the descending stream of molten metal. As shown in FIG. 3, a first pair of water discharge nozzles 22, 23 is disposed symmetrically on opposite sides of the descending, coherent stream 24 of molten metal. The nozzles 22, 23 are directed downward and inward at an angle of 15°–30° from the vertical, and are arranged to direct controlled jets of atomizing water into intercepting relation to the molten metal stream 24.

Figure 2:
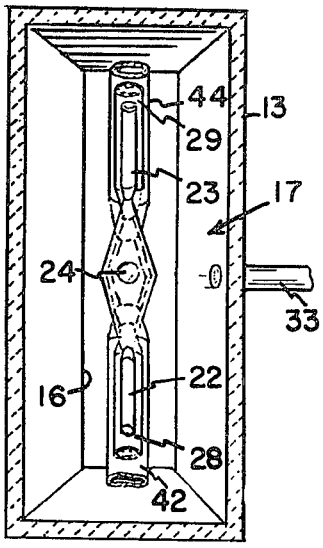
FIG. 2 is an enlarged cross section taken generally on line 2—2 of FIG. 1.

As a significant facet of the invention, it is important to derive, in the metal atomizing stage, metal particles which are fine in size and are angular and irregular in configuration. This is achieved through the use of thin, flat, solid streams 25, 26 of atomizing water, ejected from the nozzles 22, 23, at high pressure. For optimum results, the atomizing streams 25, 26 are ejected under relatively high pressures. A pressure of 300–1000 psi have been used successfully in atomizing iron and steel in a pilot scale unit. Higher pressure may be desired for larger installations; lower pressure may be desired for certain, easily atomized metal (e.g., 100 psi may be appropriate for aluminum). The spray nozzles eject solid, flat streams 25, 26 of water from points around five inches or so away from the point 27 of intersection with each other and with the descending metal stream 24. In the short distance between the nozzle tip and the and the point of intersection 27, the water streams 25, 26 will fan out somewhat to a width of about three inches, as indicated in FIG. 2, and may increase slightly in thickness.

It should be understood that, in characterizing the streams 25, 26 as solid, it is meant that they are issued from the nozzle in an essentially solid form, as distinguished from being issued in a plurality of fine side-by-side streams. As the streams fan out beyond the nozzles there may be some inherent loss of stream integrity, but such a condition is clearly within the meaning of the term solid stream as used in connection with this invention. Likewise, in describing the stream as flat, it is not intended to mean that the stream must be in a single plane; rather, it is meant that the thickness of the stream is a relatively small fraction of its width. For example, it may be appropriate in some cases to cup or upturn the jet streams 25, 26 slightly at their side edges to assist in the confinement of the metal stream, at least where the overall width of the jet streams is not exceptionally large. Such a configuration of jet streams in within the scope of meaning of the term flat as used in connection with this invention.

The interaction of the high pressure water streams 25, 26 with the descending molten stream 24 causes the molten metal stream to be literally shattered and broken up into fine particles. In conjunction with the second and subsequent stages of streams, the particles are almost instantly solidified and, due to the violence and rapidity of the solidification, the particles are derived in an irregular and angular configuration, which is highly desirable. In accordance with the invention, the interaction of the water streams 25, 26 and the descending stream of molten metal 24 is such as to produce particles predominantly of minus 40 mesh in size. This means that most of the particles produced would pass through a screen of 40 mesh (U.S. Sieve Series, A.S.T.M. specification E-11-61).

A critical facet of the present invention involves, in addition to the production of fine, atomized particles as described immediately above, the maintenance during this atomizing process of non-oxidizing conditions and, in addition, the solidification and quenching of the atomized particles in the fastest possible time to a temperature below which oxidation readily occurs. Extremely rapid solidification and quenching of the atomized particles is enabled, in part, by the production in the first instance of particles of suitable fineness, and so the conduct of the atomizing stage itself is an integral part of the invention. It has been observed, however, that the formation of atomized particles of the desired size and shape, and the sufficiently rapid transfer of heat from these particles tend to be mutually inconsistent objectives when using a single set of nozzles. Accordingly, as an important part of the invention, at least one additional set of water nozzles 28, 29 is provided in the atomizing chamber, arranged to direct streams of water 30, 31 into intersecting impingement at 32, just slightly below the intersecting impingement 27 of the principal atomizing streams 25, 26. Advantageously, the water streams 30, 31 are brought as close up to the streams 25, 26 as practicable without causing interference with the action of those streams. In practice, in an atomizing apparatus of the general dimensions and configurations described, the second stage streams 30, 31 may intersect at a point from as close as about $\frac{1}{4}$ inch to as far as about two inches below the intersection of the first stage streams, with a more typical spacing being about $\frac{3}{4}$ inch.

The second stage nozzles 28, 29 may be operated at a somewhat lower pressure than the first stage streams, say, on the order of 100 psi or more, and may advantageously deliver water in solid streams of somewhat greater thickness than the atomizing streams, substantially as illustrated in FIG. 3. The objective in the case of streams 30, 31, is to envelope the just-atomized particles in a substantial volume of water accompanied by violent turbulence. This provides for the fastest possible transfer of heat from the small metal particles to the quenching water, by minimizing sustained contact between the hot particles and unagitated water. This eliminates or greatly minimizes the formation of stagnant surface films of steam that would otherwise tend to form between the hot powder particles and the liquid during the quenching. In this respect, it will be understood, that steam is a highly reactive oxidizing medium, and surface films will quickly form and heat transfer will be impeded if there is sustained exposure of the particles to such steam films.

Most advantageously, even after exposure of the metal particles to the streams 30, 31, it is desirable to follow immediately with a further cooling stage, in order to bring the particles well below the temperature at which oxidation is promoted.

In some cases, it may be necessary or desirable to provide a third pair of water jet nozzles 42, 44, located directly under the second set of nozzles 28, 29. The third nozzles 42, 44 issue streams 46, 48, of generally the same velocity and dimensions as the streams 30, 31, arranged to intersect at 50. In general, the point of intersection 50 is located close underneath the point 32 at which the second nozzles intersect. A typical spacing may be about $\frac{3}{4}$ inch, but it may from as near as about $\frac{1}{4}$ inch to about four inches, in a pilot scale apparatus.

Whether or not a third stage of jets is utilized, the particles are discharged immediately after the last stage of jets into a highly turbulent water of the water leg and flowed in a violently agitated mixture out through the discharge opening 16 and into a large body 11 of cooling liquid retained in the vessel 10. Desirably the water issuing from the discharge nozzle 16 has sufficient discharge force velocity to maintain a desired condition of substantial turbulence within the water body 11 itself. Advantageously, the water utilized for quenching and cooling may be heated and cooled or treated with additives, prior to use, to reduce its content of dissolved oxygen, to further reduce the exposure of the metal to oxidizing conditions.

In the practice of the invention, the range of particle sizes play an important part, because there is a significant, inverse ratio between the mass of the individual particles and the surface area available for cooling contact (and also oxidation). In general, the smaller the particle size the better, up to a point. Heat is more readily extracted from a small particle, because of its favorable surface area-to-mass ratio. This reduces the time at higher temperature and the oxide formation. On the other hand, if the particles are too small, an excessive area is presented for possible oxidizing reaction, not only during quenching and cooling, but during subsequent drying, handling and storage. Moreover, if the particles are too small, compaction of the powder to form wrought products is made difficult. Optimum results in the practice of the invention are realized when the particles are within the range of between about minus 40 mesh and plus 400 mesh; advantageously, however, not more than about 40% of the particles are minus 325 mesh in size.

Notwithstanding the introduction of substantial quantities of water (e.g., at least 70 gallons per minute and in some instances 80–100 gallons in the pilot-sized equipment described) through the atomizing and quenching nozzles, and the introduction of metal, the action of the high velocity water jets within the atomizing chamber causes a substantial vacuum to be created in the chamber.

This vacuum results from the jet effect of the high velocity water streams discharged from the atomizing and quenching nozzles. This effect can develop vacuums of as much as twelve inches of mercury, and probably even greater, and under most process conditions will develop vacuums of at least three to four inches of mercury. This is and important quality feature to the process in achieving a more efficient out gassing of the metal or reduction of oxygen. The reduced pressure also favorably affects the carbon-oxygen equilibrium in the steel, such that the oxygen present will more easily react with the carbon present in the steel and be released as carbon monoxide. The release of gases is, of course, greatly facilitated by the fact that the metal is being shattered into tiny particles by the force of the first stage, high pressure sprays.

In the process of the invention, the action of high pressure sprays in a closed chamber creates a substantial vacuum in the region of the sprays. Although the development of such a vacuum results in substantial processing advantages, there is also a resulting problem, in that the vacuum tends to suck water from the retaining tank 10 through the bottom of the atomizing chamber and up into the atomizing zone, flooding the atomizer. According to the process of the invention, however, the force and velocity of the water issued from the spray jets is so directed and controlled as to largely offset and control the tendency of the atomizer to flood. Thus, the lower portion of the atomizer tapers gradually and symmetrically to a restricted discharge opening 16, which is advantageously aligned with the axis of the convergent sprays and is a relatively short distance therefrom. In the illustrated, pilot size apparatus, the discharge opening 16 is less than 40 inches below the spray nozzles.

With this arrangement, the retained water in the lower portion of the atomizer is effectively forced out through the restricted discharge opening 16, with the force and velocity of the downwardly directed water streams largely offsetting the suction effect of the vacuum created. The distance between the spray nozzles and the discharge opening 16 should not be too large, as the force and velocity of the sprays can thus be excessively dissipated within the lower portion of the chamber, significantly reducing the efficiency of the jet outflow effect.

The process of the invention often may involve the creation of vacuum within the atomizing zone of as much as twelve inches of mercury, and rarely less than three inches of mercury. Since each inch of mercury vacuum tends to be balanced by approximately one foot of water head, the atomizing zone would be quickly flooded by water from the retaining tank 10, in the absence of effective control. In accordance with the invention, the primary means for effecting such control is the jet outflow effect, which is achieved by guiding and directing the high velocity liquid streams through a restricted discharge opening at the bottom of the atomizing chamber 17. By this means, desired levels of vacuum may be maintained in the atomizing zone, and at the same time flooding of the zone is avoided. In a given atomizing chamber, the jet effect may be controlled to a degree and optimized by adjustment of the size of the discharge opening 16 by means of adjustable flap 100.

Although the jet outflow effect provides the primary basis for controlling the level of water in the atomizing chamber 17, additional control typically is necessary. In part, this is achieved by controlling the level of vacuum created in the atomizing chamber by the high velocity sprays. In the system of FIG. 1, vacuum in the atomizing chamber is controlled and maintained at desired levels by means of a supply (not shown) of non-oxidizing gas, typically an inert gas, such as argon, which is fed in through a conduit 33, by means of a flow or pressure regulator 34. In a typical operation of the described apparatus, the regulator pressure may be adjusted to achieve, in conjunction with the primary control of the jet outflow, a desired level of water in the water leg 18, which, even allowing for substantial surface turbulence, will usually provide sufficient clearance below the atomizing annd quenching jets to avoid interference. The out-gassing of metal itself may be utilized to advantage in controllably decreasing the vacuum in the atomizing chamber 17. For example, certain formulations of steel provide a "gassy" melt, because of the presence of oxygen, and advantage may be taken of the evolution of the gas during the atomizing process to help control the level of vacuum within the chamber. The oxygen generally combines with carbon present in the melt, during solidification, and comes off as carbon monoxide (CO) gas. Normally, of course, the out-gassing of the molten metal is insufficient, in itself, for adequate vacuum control, and supplementary quantities of inert gas are introduced by the regulator 34.

It is important to purge the atomizing chamber 17 prior to the commencement of the atomizing operation. Typically, this can be done by introducing argon or other non-oxidizing gas into the interior of the atomizer housing, expelling the atmospheric air, and then sealing over the crucible opening 21 with a destructible seal 122, such as a section of aluminum foil. When the molten metal subsequently is poured into the crucible, the seal 122 is instantly broken. However, the molten metal itself thereafter functions as a seal, as long as a quantity thereof remains in the crucible 19. In accordance with the process of the invention, this is assured by inserting a plug rod 123 into the opening 21 when the level of molten metal becomes appropriately low. This assures that the atomizer will remain free of air until after the atomizing operation is fully complete. To advantage, the introduction of non-oxidizing gas into the chamber is continued for a short time after inserting of the plug 123, to cause the gases in the chamber to be diluted and dissipated.

The production of water-atomized metal powders in accordance with the invention can be carried out in a manner to achieve oxide levels which have never before been achieved in a water atomizing process. In this respect, it is possible to achieve water atomized powder, the oxygen content of which is far below the 0.25% level at which it becomes necessary to perform further, costly reduction processes to condition the metal properly for many end uses. Even so, the powder produced in accordance with the invention should be handled at subsequent stages in an appropriate manner so that the dried powder available for ultimate utilization in the formation of wrought products or compacts, remains well below the 0.25% oxygen content level.

As illustrated in FIG. 1, the receiving tank 10 has its outlet 12 connected to a suitable separating device, usually of a gravity type, designated by the numeral 35. Periodically (or continuously, if desired) water and entrained particles can be flowed by a pump P or gravity to the separator 35, which is adapted to remove relatively low density impurities such as slag, furnace refractories, etc. The impurities are discharged at 36, and the mixture of water and metal powder particles is suitably drained at 37 to remove most of the water content. Thereafter, the still wet powder containing from 1% to as much as 15%–20% water, is taken directly to a drying facility 38, where the remaining water is removed. Advantageously, the drying facility 38 is a vacuum dryer, from which the air is first exhausted, (eliminating oxygen), and then the powder is heated while retaining a vacuum. This results in a dried powder with minimum oxide gain from its as-atomized, wet condition. Alternatively, the powder may be dried by specially designed drying methods.

The ability to produce water-atomized metal powders, of iron, steel, and other materials, with the extremely low oxygen content enabled by the present invention, permits extraordinary economic advantages to be realized. By way of example, an iron or steel powder thus produced, having an oxygen content well below 0.25%, can be used directly in the manufacture of strip and wrought products, without undergoing special oxygen reducing processes. Thus, iron and steel powders produced in accordance with the invention, will have at most an extremely thin oxide film at the surface, as is evidenced by a light gray cast. Most such oxide thin films can be flashed off, quickly and economically in a reducing atmosphere after compaction of the powder into a green strip and while the green strip is being conveyed through a furnace for heating to temperatures suitable for hot rolling. More conventional powders, having higher oxygen content if water atomized, typically would contain too much oxide for economical reduction during a furnace heating operation. The much heavier oxide coating of conventionally water atomized particles is characterized by a dark gray or black surface coloration (reflecting an oxygen content of 0.8% or more), in the case of iron and steel particles.

In some cases, as where it is desired to produce wrought products from iron powders having a high carbon content, it may be necessary to utilize a preliminary tempering heat treatment to soften the high carbon powder sufficiently to carry out the compacting operation. In such cases, the cost of a separate heating operation cannot be avoided. However, important advantages are still realized, in that it is possible to carry out the heating step much more rapidly than otherwise, because time consuming reducing reactions are not required. In this respect, if there is oxygen present with carbon in the powder, there is a tendency for the carbon and oxygen to react in a heat treatment operation, forming CO and $CO_2$. This results in an undesirable composition change, where a high carbon product is desired.

One very important advantage derived from this invention, in avoiding the need for a reducing step after atomization, resides in the ability to compact the powder into strip, rods, forging blanks, etc., while the powder remains in its internally stressed, "as-atomized" condition. The high energy state of the internally stressed atomized particles provides for faster reactions upon heating in an atmosphere.

The low oxygen contents achievable under the new process have not, prior to my inventions, been attainable or even approached, using conventional water atomizing techniques. Considering oxygen content alone, it has been possible to achieve such low levels using inert gas as the atomizing medium. However, atomizing processes using inert gas as the operative medium have fundamental disadvantages which more than compensate for their ability to achieve low oxide production. For one, the production rate is extremely slow; for another, the powder configuration is essentially spherical, because of the slow rate of heat transfer; and, for another, the economics of atomizing with inert gas are quite unattractive.

In the practice of the invention on a commercial scale, it may be desirable to utilize a plurality of pairs of nozzles in each stage, arranged in side by side configuration. The principles above described are fully applicable to such an arrangement. Likewise, the number of stages of quenching jets may be altered to suit given circumstances, as long as the basic relationships are observed of first shattering the molten metal stream by high pressure, flat, solid jets, followed immediately by one or more stages of quenching jets. In the procedure of the invention, the first set of intersecting sprays must be thin enough to permit the metal stream to properly penetrate through the intersecting jets, while being shattered into fine particles. The second and subsequent sets of quenching jets can be of considerably greater thickness, in part because the force of the water from the first set of sprays will assist the atomized particles in penetrating the subsequent sets of water jets.

A significant feature of the process resides in the maintenance of a non-oxidizing atmosphere within the atomizer from a time prior to commencement of atomizing, to a time after atomizing has been completed. In addition to the primary consideration of minimizing oxidation of the metal, it is also necessary to avoid explosive reaction at the commencement and termination of atomizing, as by combining of air with carbon monoxide. Pursuant to the present invention, the atomizing chamber is sealed at the bottom by water and is sealed at the top, in sequence, by a destructible seal, prior to atomization, and by the molten metal itself during atomization, the plug being inserted prior to full consumption of the molten metal in order to assure continuity of the seal.

According to the invention, a jet outflow effect, achieved by a high velocity discharge or water through a narrow, tapered discharge passage and out of a restricted discharge opening is essential. The rate of water outflow through the restricted discharge opening should be at least five gallons per minute, per square inch of area, achieving an average velocity of around 100 feet per minute. In the absence of such a confinement and control of the velocity and force of water outflow, the high vacuum created in the atomizing chamber by the high velocity water sprays can draw water up into the atomizing zone, even though gas is being introduced into the chamber to control the level of the vacuum.

Since atomizing of various metals at varying rates, and where the metals have different gas contents, melting points and specific heat values, may require different volumes and velocities of water flow through the atomizing and quenching nozzles, provision is made in accordance with the invention for controllably restricting the water leg discharge outlet, in order to maintain the desired high velocity outflow.

Following the procedure of the invention, a small atomizer of about 10×15 inches cross section at the top and an overall height of 40 inches, can easily process 120 pounds per minute of molten metal. With side by side sets of nozzles, and higher capacity pumps, this capacity could be greatly increased.

The process of the invention is suitable for the atomizing of any metals that can be conveniently melted and poured. It is particularly advantageous in the processing of steel and steel alloys, nickel and nickel alloys, copper and copper alloys and any other metals in which oxide formation is undesirable. In the process of the invention, the oxygen content of the steel is increased less than 0.2% during atomizing and drying.

The process of the invention may be employed to particular advantage in the production of high compressibility and pre-alloyed powder for the production of powder metal parts and of forging preforms. Annealing of the powder for improving compressibility is greatly simplified and expedited, because extensive reduction of oxides is not required. The extremely low oxide content achieved during the atomizing process of the invention enables important advantages to be achieved in the production of tool steels and other special alloys incorporating alloying constituents, such as chromium, molybdenum, silicon, etc., where oxides of the alloying constituents may prove difficult or impossible to eliminate, once formed. The process of the invention also permits the production of pre-alloyed powders, which include a relatively high carbon content. Because of the substantial absence of oxygen in the atomized powder, high carbon pre-alloyed powders may be effectively annealed for improving compressibility, without necessitating an extended reducing period. Such a reducing operation, which would be required to eliminate high oxide content, would result in undesirable carbon-oxygen reactions, diminishing the desired high carbon content in the material.

The present invention is ideally suited for production on an industrial scale, using equipment of a practical, trouble-free nature, which can be set up and operated on an economic basis.

It should be understood, of course, that the foregoing description of the invention is intended to be representative only. Reference should be made to the following appended claims in determing the full scope of the invention. In the foregoing specification, and in the claims, the term "iron" shall be considered to include steel, wherever the context admits thereof, and the term "steel" shall be considered to include alloys containing 50% or more iron by weight.

I claim:

1. The method of atomizing molten metal which comprises the steps of (a) directing a stream of molten metal downwardly into an enclosed, sealed, partially evacuated chamber through a restricted top opening formed in said chamber, (b) impinging upon said stream of molten metal in an atomizing zone within said chamber high velocity jets of water at high pressure in two or more stages, including a first stage comprising a pair of thin, flat-shaped jets which atomize the metal stream and convert the metal stream into fine particles co-mingled with said water, (c) guiding and confining the co-mingled water and metal particles directly downward through a flow passage of gradually decreasing cross section including a restricted discharge outlet at the lower end of said flow passage, (d) sealing the lower end of said flow passage at said restricted discharge outlet by maintaining an open, confined body of water at a level above said restricted discharge outlet, (e) causing said atomizing zone of said chamber to be maintained under a partial vacuum by reason of the discharge thereinto of said high velocity jets of water whereby said partial vacuum causes water from said open, confined body to rise upwardly through the restricted discharge outlet and flow passage and into said chamber to form a water leg, (f) arranging said atomizing zone at a height in relation to the surface level of said open, confined body of water which is less than the height of said water leg required to equalize the partial vacuum in said atomizing zone, (g) directing said high velocity jets of water in a generally downward direction directly toward said restricted discharge outlet with sufficient force and velocity whereby the water jets force the co-mingled water and metal particles downward and through the restricted discharge outlet with sufficient force and velocity to balance and largely offset the suction force created by the partial vacuum in said atomizing zone to establish the level of water in said water leg below the atomizing zone, (h) discharging the downwardly flowing co-mingled water and metal particles through the restricted discharge outlet and into the open, confined body of water, and (i) conducting steps (b), (c) and (h) in rapid sequence to achieve rapid quenching and cooling of the atomized particles to a temperature sufficiently low to avoid oxidation of the metal particles.

2. The method of claim 1 wherein said atomizing zone is purged of air by introducing a non-oxidizing gas prior to step (a) of claim 1.

3. The method of claim 1 wherein the level of partial vacuum within said atomizing zone is controlled in part by controllably introducing into said zone a non-oxidizing gas.

4. The method of claim 1 wherein said high velocity jets of atomizing water comprise (a) a first pair of thin, flat, solid streams directed downwardly at an angle of about 15° to 30° from the vertical and intersecting in a Vee with the stream of molten metal, (b) at least one additional pair of streams arranged immediately below said first pair and intersecting in a Vee along the axis of the molten metal stream, and (c) said additional streams being of greater thickness than the first pair of atomizing water streams.

5. The method of claim 4 wherein (a) there is at least a third pair of water streams which intersect below said one additional pair, (b) said additional pair intersects between one-quarter of an inch and two inches below said first pair, and (c) said third pair intersects between one-quarter of an inch and four inches below the additional pair.

6. The method of claim 1 wherein the partial vacuum within said zone is controlled in part by adjusting the cross sectional area of said restricted discharge outlet.

7. The method of claim 1 wherein the partial vacuum in said atomizing zone is maintained at a level of not less than about three inches of mercury.

8. The method of claim 1 wherein said co-mingled water and metal particles are discharged from said restricted discharge outlet at a rate of not less than about five gallons per minute per square inch of cross sectional area of said restricted discharge outlet.

9. The method of claim 1 wherein said co-mingled water and metal particles are discharge from said restricted discharge outlet at a velocity of at least about 100 feet per minute.

10. The method of claim 1 wherein the ratio of cross sectional area of the chamber to the cross sectional area of said restricted discharge outlet is on the order of 150:9 whereby the downward force and velocity of the water jets causes a jet outflow effect at the restricted discharge outlet thereby controlling the level of the water leg in the atomizing chamber.

* * * * *